US007686699B2

(12) United States Patent
Snyders

(10) Patent No.: US 7,686,699 B2
(45) Date of Patent: Mar. 30, 2010

(54) WEARABLE GOLF SWING TRAINING AID AND METHOD OF USING THE SAME

(76) Inventor: Herman William Snyders, 461 Golden Oak Drive, Oakville, ON (CA) L6H 3Y3

( * ) Notice: Subject to any disclaimer, the term of this patent is extended or adjusted under 35 U.S.C. 154(b) by 0 days.

(21) Appl. No.: 12/015,827

(22) Filed: Jan. 17, 2008

(65) Prior Publication Data

US 2008/0176665 A1 Jul. 24, 2008

(51) Int. Cl.
*A63B 69/36* (2006.01)

(52) U.S. Cl. ..... 473/216; 473/215

(58) Field of Classification Search ..... 473/207, 473/212, 213, 214, 215, 216, 217, 219, 266, 473/269, 276, 277
See application file for complete search history.

(56) References Cited

U.S. PATENT DOCUMENTS

| | | | | |
|---|---|---|---|---|
| 1,591,524 | A * | 7/1926 | Fuller | 473/215 |
| 1,669,457 | A * | 5/1928 | Dailey | 473/215 |
| 2,773,691 | A * | 12/1956 | Redfield | 473/212 |
| 2,940,237 | A | 6/1960 | Alcock et al. | |
| 3,069,169 | A * | 12/1962 | Topping | 473/212 |
| 3,679,214 | A | 7/1972 | Boyte | |
| 3,945,041 | A | 3/1976 | Rhee | |
| 4,061,340 | A | 12/1977 | Husted | |
| 4,294,239 | A | 10/1981 | Oram et al. | |
| 4,519,608 | A * | 5/1985 | Gilly | 473/461 |
| 4,688,800 | A | 8/1987 | Lopez | |
| 5,188,365 | A * | 2/1993 | Picard | 473/213 |
| 5,846,143 | A | 12/1998 | Brock et al. | |
| 6,251,025 | B1 | 6/2001 | Brock et al. | |
| 6,503,148 | B2 * | 1/2003 | Lane | 473/215 |
| 6,514,150 | B1 * | 2/2003 | Corder | 473/214 |
| 6,767,290 | B1 | 7/2004 | Tan | |
| 6,800,035 | B1 * | 10/2004 | Couch | 473/213 |
| 6,805,640 | B2 * | 10/2004 | Kim et al. | 473/226 |
| 7,033,284 | B2 * | 4/2006 | Yoshimura | 473/276 |
| 2002/0039930 | A1 | 4/2002 | Smith | |
| 2003/0148814 | A1 | 8/2003 | Kim et al. | |

FOREIGN PATENT DOCUMENTS

| | | |
|---|---|---|
| DE | 10039492 A1 | 2/2002 |
| GB | 2201603 A | 9/1988 |

(Continued)

*Primary Examiner*—Nini Legesse
(74) *Attorney, Agent, or Firm*—Vidas, Arrett & Steinkraus

(57) ABSTRACT

A wearable swing training aid for golfers, for use in association with a golf swing which includes a take-away portion and an impact, to follow through portion. The aid has a guide to guide one arm of said golfer during said take-away portion of said golf swing and a limiter to limit movement of the other arm of the golfer past the golfers body during the follow through portion of the golf swing. An adjustable belt is used for securing and positioning the guide and the limiter of the swing training aid onto the body of a golfer. The guide and the limiter are positioned to cause said golfer to move said arms in a controlled manner through said golf swing to thereby limit the position of the golfer through the golf swing to mimic an preferred golf swing. A further aspect of the invention is a method of using the wearable swing training aid to learn a preferred golf swing.

16 Claims, 8 Drawing Sheets

FOREIGN PATENT DOCUMENTS

| | | |
|---|---|---|
| WO | 99/08758 | 2/1999 |
| WO | 99/54003 | 10/1999 |
| WO | 00/06262 | 2/2000 |
| WO | 00/06263 | 2/2000 |
| WO | 01/07123 A2 | 2/2001 |

* cited by examiner

WEARABLE GOLF SWING TRAINING AID AND METHOD OF USING THE SAME

CROSS-REFERENCE TO RELATED APPLICATIONS

This application claims the benefit of Canadian Patent Application No. 2,574,585, filed Jan. 19, 2007, the contents of which are hereby incorporated by reference.

FIELD OF THE INVENTION

This invention relates generally to the field of sporting equipment and more specifically to the field of golf sports equipment. Most particularly this invention relates to golf sports training equipment of the type that can be used to help train a golfer to perform a preferred golf swing, and to methods of using the sports training equipment for this purpose.

BACKGROUND OF THE INVENTION

One of the most studied movements in all of athletics is the golf swing. In a game of golf, a player uses a series of clubs, traditionally called woods, irons and a putter, to strike a golf ball and to propel it across a golf course from tee to green and into a hole. The series of clubs used have club shafts of different lengths; different sizes of club head and different striking face angles or lofts. Each club is designed to propel a golf ball a different distance. A golfer must select the appropriate club for each shot and then make a repeatable controlled swing to propel the ball the appropriate distance.

There are many subtleties in striking the ball to limit its flight path. Fades, draws, hooks and slices, and high and low shots can be used depending upon the obstacles facing the golfer and the natural conditions such as wind and the like. The flight path is generally controlled by the way the club is held in the hands, traditionally referred to as the grip, by ball position relative to the middle of the stance, and by varying the position of the feet, referred to as open or closed stance. Ball flight for specialty shots can be controlled by body and or arm movement, but for the preferred down the middle of the fairway ball flight, distance is attained by club selection and accuracy by a controlled consistent golf swing. One of the skills required for playing golf therefore is to make substantially the same golf swing each time the ball is struck, and to vary the distance the ball travels by means of the club selection.

The swing itself starts with the address, in which the golfer gripping the club with both hands positions the club head behind the ball in a position in which the club will make good contact with the ball. Then, the first part of the golf swing occurs, which is called the take-away, in which the golfer swings the club back away from the ball to a top position. Then there is a change in direction, initiated by the golfer shifting his weight to the target side and dropping the golf club downwardly into the proper position. The club head arcs through the air and strikes the ball. After impact the club momentum carries the club and the hands through in the direction of the target, in a portion of the swing known as the follow through.

Wikipedia describes the golf swing generally as follows: A full swing is a complex rotation of the body aimed at accelerating the club head to a great speed. For a right handed golfer, at address, the player stands with the left shoulder and hip pointing in the intended direction of ball flight, with the ball before the feet. The club is held with both hands (right below left), the club head resting on the ground behind the ball, hips and knees somewhat flexed, and the arms hanging from the shoulders. The backswing is a rotation to the right, consisting of a shifting of the player's body weight to the right side, a turning of the pelvis and shoulders, lifting of the arms and flexing of the elbows and wrists. At the end of the backswing the hands and arms are above and in front of the right shoulder, with the club, behind and over the shoulders, in a line more or less in the intended direction of ball flight. Not included in the Wikipedia description, but critical to the down swing, is the sequencing of the weight shift from right foot to the left foot, timed with the dropping of the right arm into the correct position or "slot". The body must turn through out the golf swing to ensure the arms stay in front of the chest in the take-away and follow through.

After the ball is hit, the follow-through stage consists of a continued rotation to the left. At the end of the swing, the weight has shifted almost entirely to the left foot, the body is fully turned to the left and the hands are above, and in front of the left shoulder, with the club hanging down over the players'back.

Wikipedia further states that the full golf swing is an unnatural, highly complex motion and notoriously difficult to learn. It is not uncommon for beginners to spend several months practicing the very basics before playing their first ball on a course. It is usually considered impossible to acquire a stable and successful swing without professional instruction and even highly skilled golfers may continue to take golf lessons for many years.

To assist in learning the complex and difficult action many swing training aid devices have been proposed in the past. They are based on the premise that if the golfer can repeat the preferred swing motion with the help of an aid, off the course, the golfer's muscles, by forced repeating of the correct motion, will achieve a muscle memory of the correct swing. In this way the golfer will be able to replicate the correct swing, on the course, without the swing training aid. Thus, swing training aids are based on the concept of a muscle memory or learned movement.

These devices interact with the golfer's swing in different ways. In one type, a large hoop or circle is provided against which the golfer matches his swing, by running his club along the swing guide hoop. However, such a guide may only guide the swing when the golfer is next to it. Since it only controls the position of the golf club, rather than the body of the user it is indirect at best. Another device, called the inside approach, tries to cause the golfer to have the correct swing path adjacent to the golf ball by placing an element close, but above, the ball under which the club must pass. If the swing is off line, the element is touched or knocked away providing instant feedback to the golfer that the swing was incorrect. However this device does not limit the position of the arms or the correct timing for the opening of the hips and weight transfer during the swing.

Other swing devices are known which involve straps attached to the body. The devices are based on the idea that certain body parts are kept at the same distance from each other during the swing. This assumption is questionable given the complex body movements that occur during the golf swing. Others involve resilient or flexible elements that introduce forces or friction during the swing, leading to the development of out of balance swings in the absence of such resilient or flexible elements. Quite simply, such strap type devices cannot properly direct the body through all of the complex motions required during a golf swing.

As a result, a swing training device that is simple to use and effective has long been sought. Examples of such devices may be found in the following prior patents:

Fixed to Ground
PCT/US1999/017154
Guides
U.S. Pat. No. 4,061,340
U.S. Pat. No. 4,688,800
U.S. Pat. No. 2,773,691
U.S. Pat. No. 6,767,290
Straps
DE 10039492
U.S. Pat. No. 3,679,214
US 2002/039930
U.S. Pat. No. 2,940,237
GB 2,201,603
U.S. Pat. No. 6,767,290
Things That Attach to the Clubs
PCT/NZ1999/000123
PCT/US1999/008467
PCT/US1998/016755
PCT/US2000/020190
US 2002/097296
U.S. Pat. No. 2,273,336
US 2003/148814
U.S. Pat. No. 6,251,025
Torso Belts
U.S. Pat. No. 4,294,239
U.S. Pat. No. 3,945,041
U.S. Pat. No. 5,846,143
U.S. Pat. No. 6,805,640

In spite of all of these prior devices there remains a need for a simple to use and effective swing training aid. What is desired is a simple swing training aid that is reliable in establishing a conventional repeatable golf swing so as to be able to train the golfer's muscles to create the desired muscle memory.

SUMMARY OF THE INVENTION

According to a first aspect of the present invention there is provided a wearable swing training aid for golfers, for use in association with a golf swing which includes a take-away portion, an impact position, and a follow through portion, the swing training aid comprising:

a guide to guide one arm of said golfer during said take-away portion of said golf swing;

a limiter to limit movement of the other arm of the golfer past said golfers body, from start of downswing to about said impact position then through said follow through portion of said golf swing; and a means for releasably securing and adjusting the guide and the limiter of the swing training aid onto the body of a golfer, wherein said guide and said limiter cause said golfer to move said arms in a limited manner through said golf swing to thereby limit the position of the golfer through the golf swing.

In a preferred form of the invention the guide is in the form of an upwardly rounded element extending from the body or torso of the golfer to provide a guide to the back of the golfer's arm during the take-away. A cross member is used to help the golfer know, by contact, when the top position has been reached and the guide and the cross member can be adjusted in position on the body. The limiter is secured in a manner so that it extends outwardly from the body, and can be independently positioned and used from the guide on the user. The limiter can be placed in a position on the body at setup where the golfer's arm will encounter it at or before an impact position. The position of limiter will cause the golfer to execute a correct body movement for that part of the swing.

According to a further aspect of the invention the present invention is also directed to a method of practicing a golf swing comprising a means of:

securing a guide element to the torso of a golfer, said guide element being in the form of an upwardly and outwardly projecting guide element;

positioning the guide element to permit the golfer's arm to be guided during the take-away portion of the swing; and repeating the golf swing with the guide in place to guide the golfer's arm.

According to a further aspect of the invention, the timing of the opening of the hips of the golfer can, optionally, be varied by altering the position of the limiter on the releasable securing means.

According to a further aspect of the invention, the elongated element may, optionally, have an outer surface texture to facilitate the sliding of the one arm along the guide during a golf swing guide.

BRIEF DESCRIPTION OF THE DRAWINGS

Reference will now be made to preferred embodiments of the present invention with reference, by way of example only, to the following figures, in which.

DETAILED DESCRIPTION OF THE PREFERRED EMBODIMENTS

Figure 1:
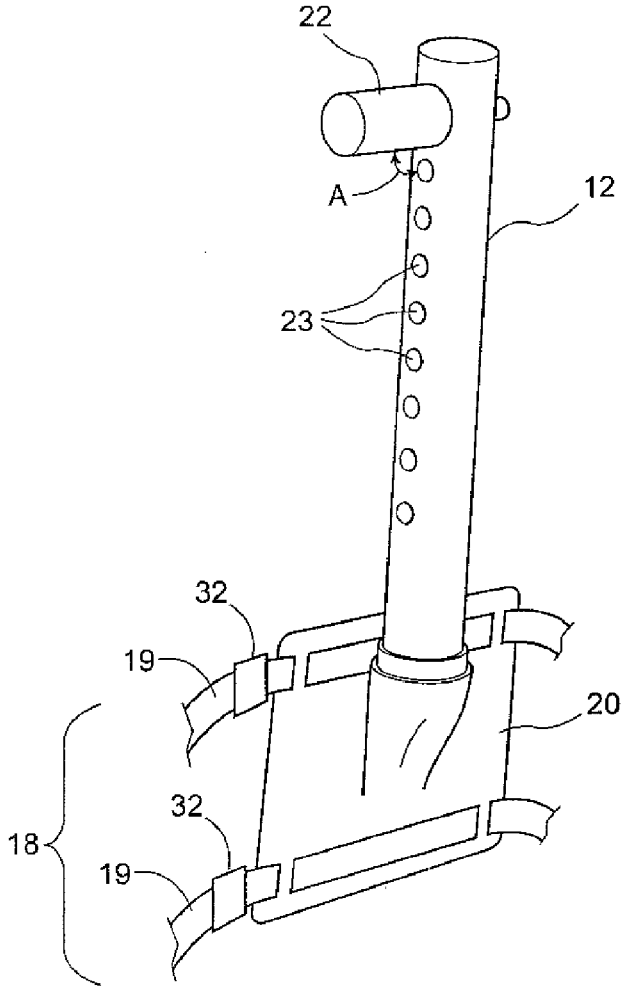
FIG. 1 shows the guide part of the wearable swing training aid of the present invention.
Figure 3:
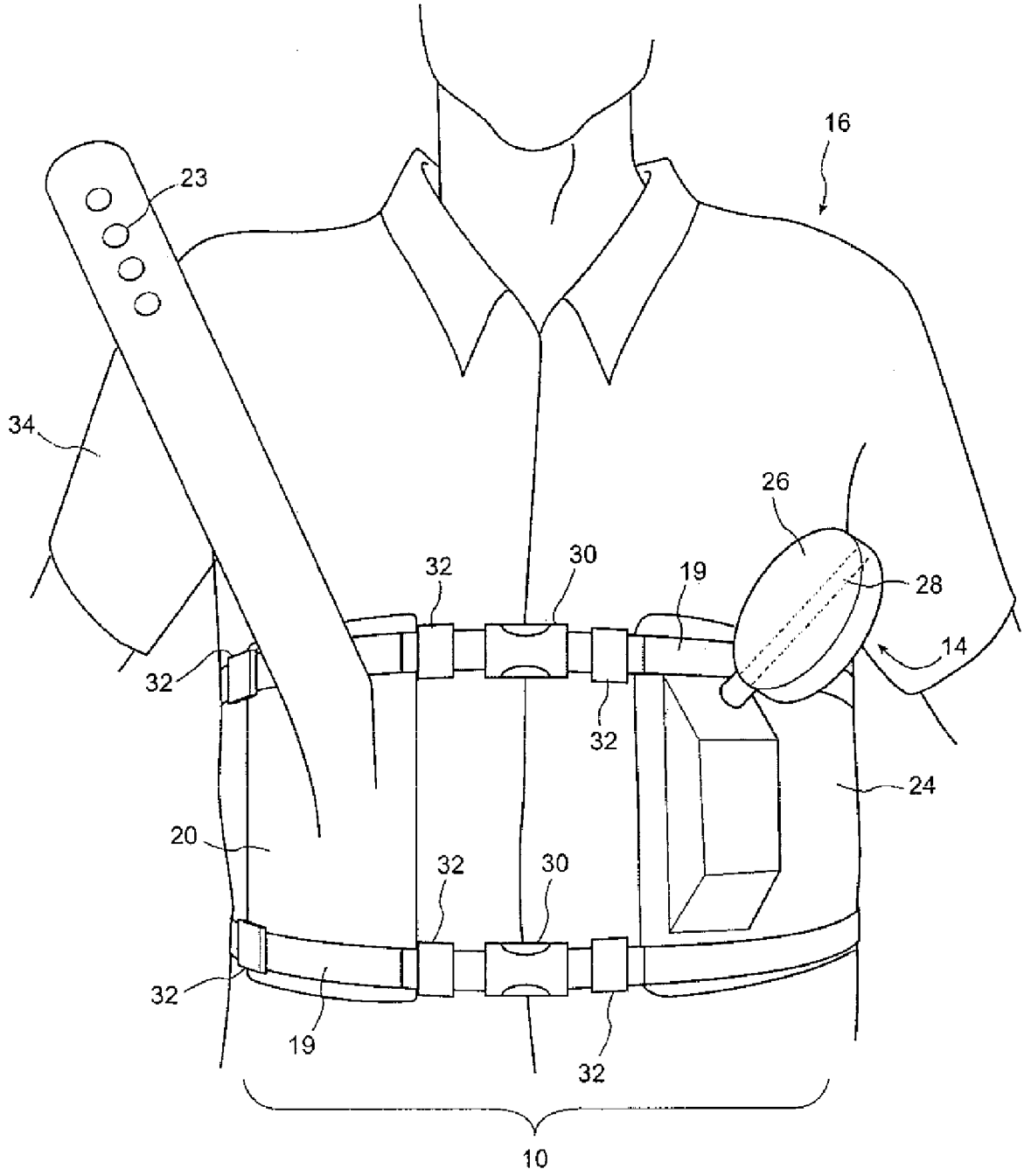
FIG. 3 shows the swing training aid of FIGS. 1 and 2 on the torso of a golfer; Note: guide would actually be on side of golfer behind arm, as in FIG. 4, it is placed in front for clarity.

A golf swing training aid according to the present invention is shown as 10 in FIG. 3. The present invention is intended to be worn by a golfer and thus may be called a wearable swing training aid, but for the ease of illustration is shown without a golfer in FIG. 1. The preferred position of the swing training aid on a golfer and its manner of use is shown in other figures and explained in more detail below.

The swing training aid 10 includes a guide 12, a limiter 14 and a means for releasably securing the guide and the limiter to the torso of a golfer 16, which in the preferred form of the invention takes the form of an adjustable torso belt 18. In one form of the invention the torso belt 18 includes a pair of torso straps 19. Although torso straps are shown, depending upon the body size and shape of the golfer, shoulder straps may also be added to help stabilize the position of the aid 10 on the body of the user.

Turning first to the guide 12, it can be seen that the guide 12 extends from a support pad 20 of the belt 18, as a projection.

When the belt is worn around the torso of the golfer, the guide 12 extends both outwardly and upwardly. As explained in more detail below, the purpose of the guide 12 is to guide the golfers' trailing arm during the take-away portion of the swing.

The preferred form of the guide 12 is to have a curved, in cross section, profile against which the golfer's arm can slide during the take-away part of the golf swing. A tube shaped projection has provided adequate results but the present invention comprehends other types of guiding surfaces, including flat or planar ones. By being curved however, the guide provides a guiding surface which comfortably interacts with the arm of the golfer, and is easy to slide past. Further, the curved profile permits smooth sliding contact with the golfer's trailing arm, for many different sizes and shapes of golfers, during both the take-away and the downward portion of the golf swing. As well, the rounded cross sectional shape limits the surface area contact, without point loading, thereby permitting the guide to guide without interfering with the arm movement by creating too much drag. In this regard a material having a low coefficient of friction surface is most preferred for the guide. Adequate results have been achieved with smooth molded plastics, such as ABS or PVC plastic and aluminum. Thus the present invention comprehends a low friction material or a surface coating which will lower the frictional forces arising as the arm of the golfer moves up and down past the guide during the relevant portion of the golf swing.

In a further aspect of the present invention a cross member 22 is provided on the guide to limit movement of the golfer's arm at the top of the take-away. Most preferably the cross member extends at an angle A (see FIG. 1) to limit the upward movement of the upper arm, causing the forearm to bend at a right angle to form the classic L-shape at the top of the swing. To accommodate different body types the present invention provides the position of the cross piece can be adjusted on the guide, from closer to the base to further out from the base of the guide. In one embodiment this is accomplished by a series of holes 23 through the guide post into which the cross member 22 can be inserted. However there are many ways of adjusting the position of the cross member of the guide that are comprehended by this invention, including a sliding clampable collar over the post or in sliding track in the post or other equivalent means. What is desired is to be able to position the cross member 22 so it stops movement of the upper arm during the top portion of the take-away to guide the golfer's arms to assume the correct position at the top of the take-away.

Turning now to the limiter 14, as shown it extends from a support pad 24 on the belt 18, and projects outwardly and upwardly to interact with the other (leading) arm of the golfer during the golf swing. In this specification, the term limiter is used, and it means to limit or control the arm. Most preferably the limiter 14 includes a limit plate 26 against which the golfers leading arm can bear during the follow through portion of the golf swing. In a preferred form of the invention the limit plate 26 is planar and rounded, in plan view, but other shapes are also comprehended. For example a square or rectangular shape would also provide adequate results as would a slightly cupped shape into which the arm of the golfer could be comfortably engaged. Also, the present invention comprehends as a post type of limiter, with or without movable parts, the post being round or half moon-shaped in cross-sectional profile, curved, or angled to better fit the arm. However, a flat round limiter plate has provided adequate results. The limiter also includes an outwardly extending support post 28 onto which the limit plate 26 is mounted. Most preferable the limit plate 26 can pivot on the support post 28. The pivot action is about the axis of the support post, meaning the angle of the limit plate is defined by the interaction of the limit plate with the arm of the golfer. In this manner the limit plate can lie flush against the arm of a golfer, no matter what the shape of the golfer's arm might be. Again this pivoting permits a more comfortable interaction between the golfer and the swing training aid of the present invention.

Turning now to the belt or strap 18, it provides the foundation for the guide and the limiter and connects the same to the torso of the user or golfer. The strap 18 is sized and shaped to securely attach the swing training aid 10 around the torso of the golfer. There are two aspects to position the belt 18 to ensure that it remains in a preferred position during the swing. The first aspect is to prevent the belt 18 from slipping sideways, around the torso. The second aspect is to prevent the belt from slipping up or down on the torso during a swing. Thus the belt must be sized and shaped to be secured, comfortably around the torso of the user in a manner that limits both types of movement. As previously noted, shoulder straps may help in this regard and are comprehended by the present invention.

Thus, the preferred form of the present invention comprehends a fairly wide belt, from top to bottom, when placed on the user, to provide sufficient surface contact area between the torso and the belt to keep the belt in place. This is accomplished by spacing the two straps 19 somewhat apart. Additionally the present invention comprehends using a friction enhancing inner surface on the support pads 20, 24, such as a layer of open cell foam, which can also act as a cushioning material for the comfort of the golfer as well as improving the grip on the torso of the user. As well, the contact areas between the belt, guide or limiter can have a friction enhancing surface, such as being roughened or sharp teeth added, to improve the grip and to prevent slipping.

Slightly different design considerations apply to the design of the belt for female golfers, in that the belt must be sized and shaped to fit comfortably below or on the top of breast of a female golfer, to be able to secure the belt tightly enough to ensure that it remains in place during swing practice. This places a limit on how high the upper edge may be positioned from the shoulders of the female golfer. However, the present invention has been used to yield satisfactory results with women golfers as well.

Figure 2:
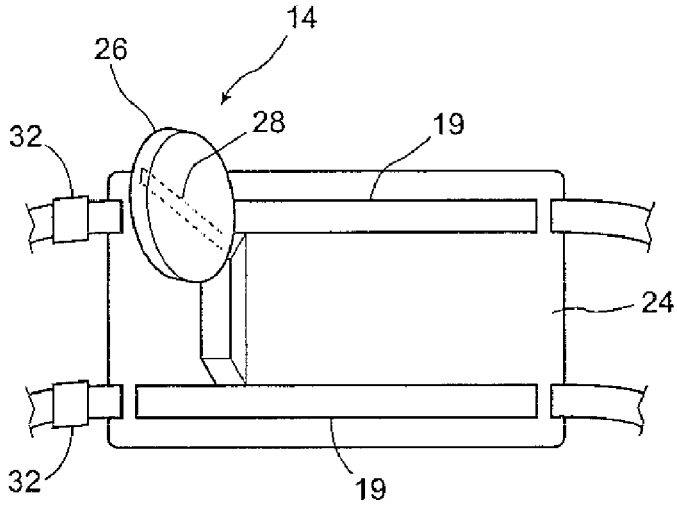
FIG. 2 shows the limiter part of the wearable swing training aid of the present invention.

Most preferably the belt includes on the straps 19 quick release buckles 30 the permit the belt to be easily released from the torso of the golfer. Such buckles 30 will include the usual loops to permit the strap length to be adjusted to suit the needs of the individual golfer. A preferred form of the invention is a belt, elastic or non-elastic, connected to non-elastic swing training elements 20 and 21 in FIGS. 1 and 2 respectively. The belt attaches to the training elements with a buckle or snap, or simply goes through a slot or hole in the training element, and attaches back on to itself with a buckle or Velcro™. This permits the invention to be securely tightened onto a torso of the user.

Another aspect of the present invention is the inclusion of adjustment means for each of the guide and the limiter on the belt. Every golfers physiology is slightly different meaning that once the belt is secured in position, the limiter needs to be positioned relative to the golfers body in a preferred position, and the guide also needs to be positioned on the body in a preferred position, which positions may well be unique to the golfer and related to the size and shape of the golfer's arms, their shoulders and their torso. This is so even when trying to teach the same swing mechanics or motion to each golfer. It will be appreciated therefore that the present invention is flexible in configuration so as to be positioned to suit the individual characteristics of different golfers in a way that permits each golfer to emulate a classic good swing.

To this end the present invention contemplates adjustment means for each of the limiter and the guide. For the guide, the adjustment means include being able to rotate the guide on a base and/or moving the top of the guide along the belt more than the bottom, thereby change the angle and position of the guide, as well as being able to move the guide along the belt to permit the position of the guide to be appropriate. The height of the guide can also be adjusted by moving the belt up or down on the torso of the user. Anti-slip buckles 32 can be used to help ensure the position of the guide and the limiter on the straps 19 remains constant and is adjustable.

The same adjustability is provided for the limiter according to the present invention. It is to be noted that some adjustability of position of both the guide and the limiter is provided by being able to position the belt on the torso of the golfer and thus the adjustability of position of the limiter and the guide relative to the belt is not essential to the present invention. However for maximum flexibility of use such adjustments are preferred. Further, adequate results may be achieved by making one of the elements adjustable. However, the most flexible configuration for the present invention is to make both elements adjustable on the belt, to give the greatest comfort and best fit to the individual golfer practicing their swing with the swing training aid.

Having described the basic elements of the present invention the method of positioning the swing training aid according to the present invention on the torso of a golfer can now be understood. The following description applies to a right handed player. As will be understood for a left handed player the elements are simply reversed in the following description. Since the limiter 14 and the guide 12 are interchangeable, to convert from one hand to the other simply requires detaching them for the one position, reversing the position of the two elements and then reattaching them in the correct position to the straps 19 having regard to the handedness of the user. Although the guide can be interchanged for a left handed player without any adjustment, the limiter has to be unfastened and refastened and base plate inverted. The first step in positioning the swing training aid 10 on the golfer is to undue the buckles 30 and to place the swing training aid 10, like a belt, around the back, with the buckles and clips at the front. The guide 12 and the limiter 14 should both be facing outwardly and upwardly. When this is confirmed then the buckles 30 can be clipped together. If the belt is not tight enough, the ends of the straps can be pulled, in a known manner, to tighten the belt to be a snug fit.

Now the guide element and the limiter can be moved along the belt by sliding them to the left or right as required by the specific physiology of the person wearing the swing training aid. The guide 12 will be located on the right side (to guide the take-away) and the limiter 14 will be located on the left side to limit the movement of the arms at impact and follow through, as well as force the hips to open and the weight to shift.

Figure 4:
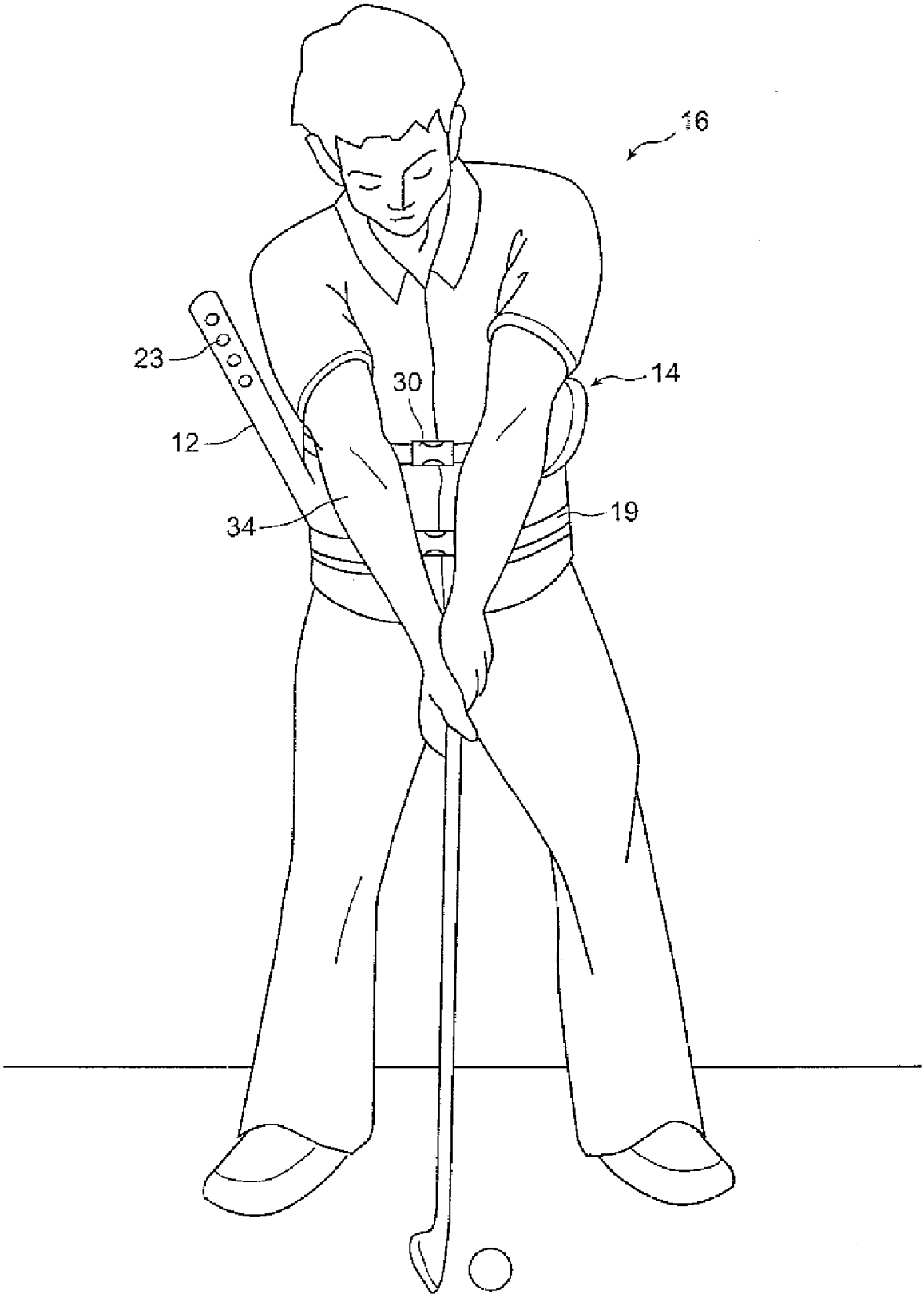
FIG. 4 shows the golfer of FIG. 2 in the address position wearing the swing training aid of FIGS. 1 and 2, with the guide and limiter in the proper position.
Figure 5:
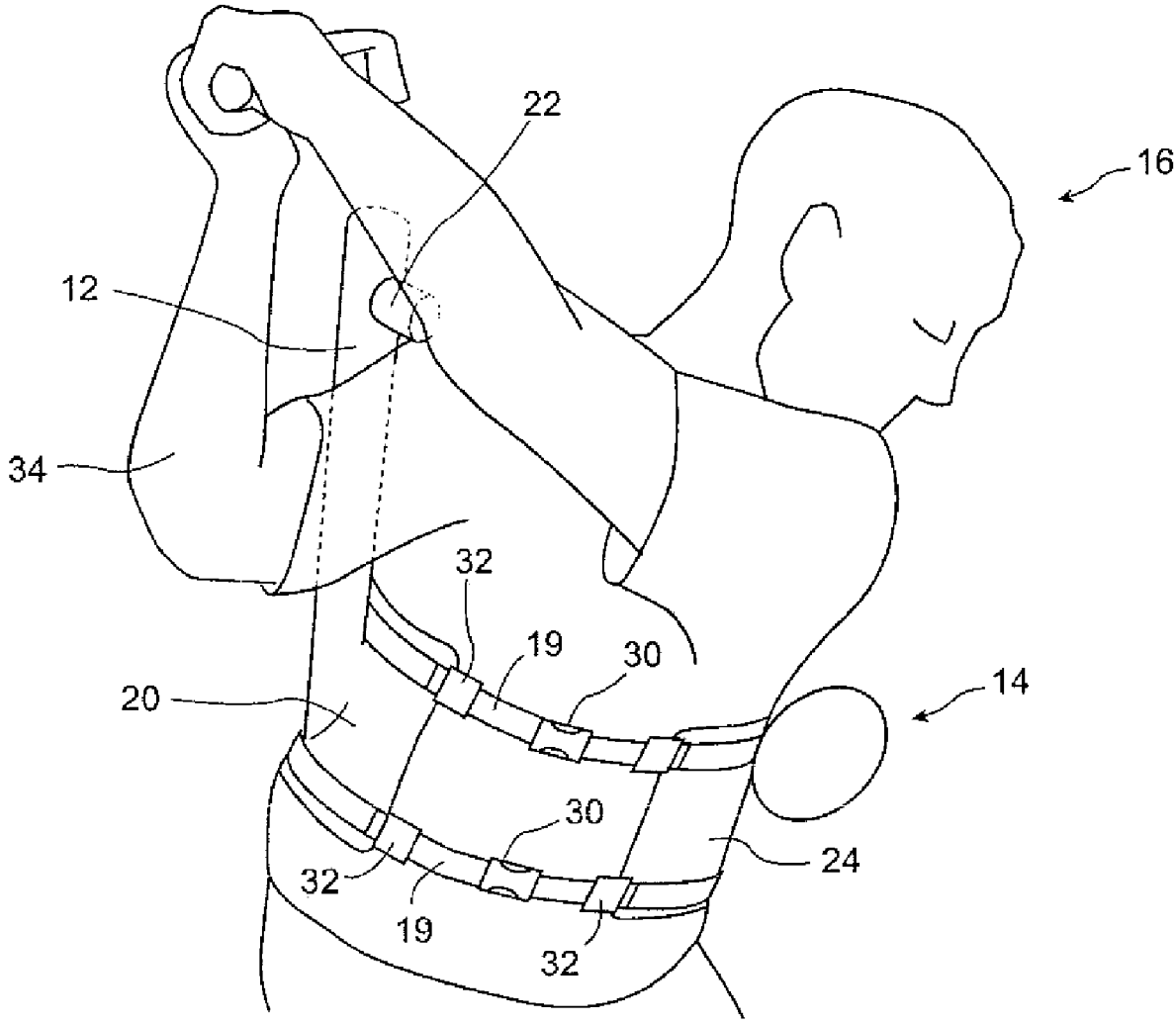
FIG. 5 shows the golfer at the top of the take-away.
Figure 6:
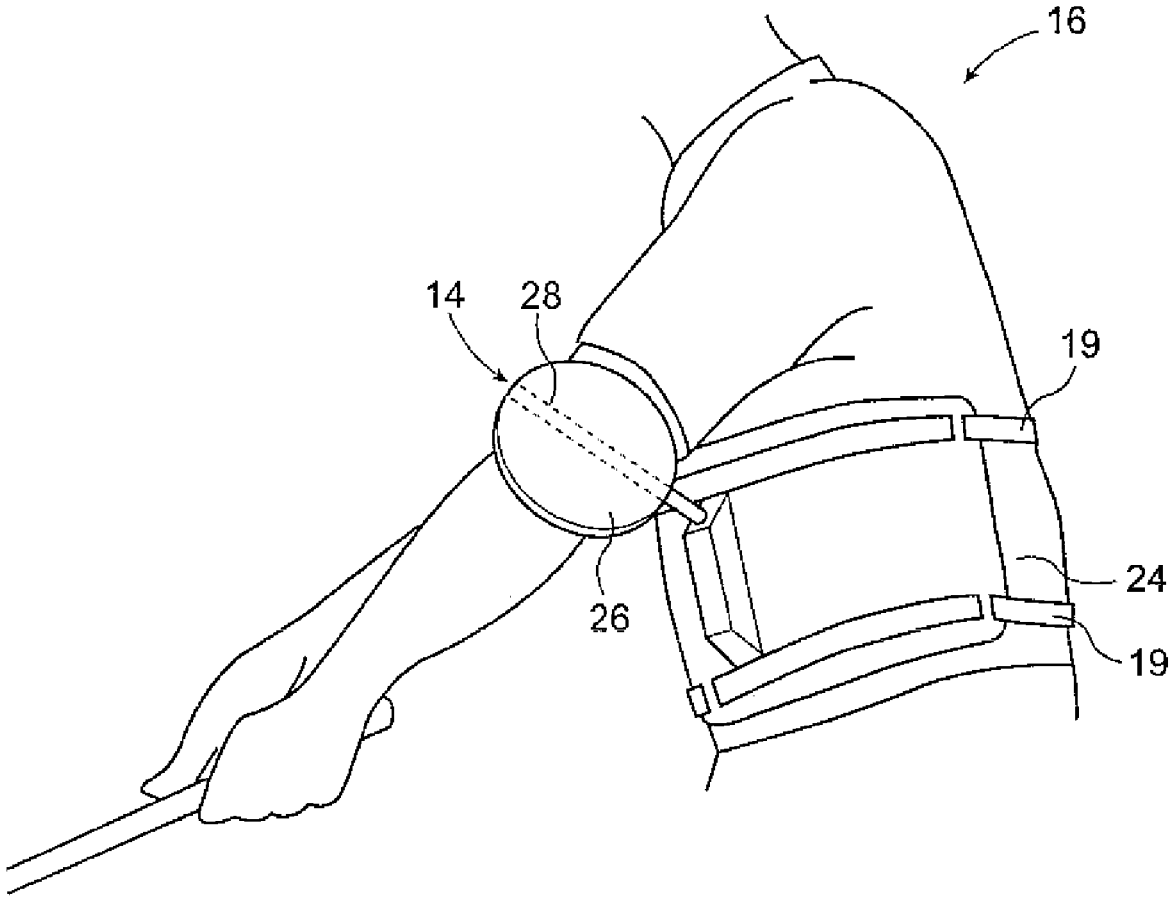
FIG. 6 shows the limiter during a swing at the point of just at or after ball impact.

As shown in FIG. 4, good results have been obtained when the guide 12 is located just inside of the persons' right arm 34. To determine the preferred location the user can simply lift their arms out from their sides, turn their head only, without turning their torso, and position the guide 12 to be at the edge of their field of view. It will be appreciated that both the top position of the guide and the bottom position need to be correct, to act as the proper guide, and this can be accomplished by varying the angle of the guide in its base as previously discussed. The ideal position for the guide is to be in contact with the user's arm through the take-away to the top position with the proper L-shaped bend in the arm.

The interaction of the golfer's arm with the guide 12 can now be understood. As the arms are drawn back during the start of the take-away portion of the swing, the right arm will contact the guide. As the take-away continues the back of the right arm will be guided by the post 12 and prevented from getting behind the body. The arm will slide smoothly and easily up the guide 12, tracking the correct elbow position for the swing. Then at the correct top of the take-away the cross member 22 stops the upper arm, causing the elbow to break and assume the preferred L-shaped top position. As will now be understood, the elbow is now in the correct position to drop into the proper "slot" for the return down swing. The arm, sliding down now along the guide 12 is directed through the downswing to maintain the proper position of arms shoulders. It will be now understood that the guide 12 is sized and shaped to provide contact to the upper arm of the golfer in a way to guide it first up and then down the preferred golf swing by means of a simple sliding contact. Because the golfer can feel the guide post with his arm it provides a tactile guide for the user, without applying force or causing an imbalance. The present invention comprehends that various shapes of guide can be used, but adequate results have been achieved with a straight guide (along the path of the swing) to guide the arm straight up and then straight down as described below. The guide 12 is positioned so that the golfer can comfortably slide his right elbow into their right side along the guide in the classic "side pocket" move.

The limiter is placed in an area from the center of the chest to the left breast, with the golfer in the address position. Then the limiter is then adjusted against the left arm so the left arm makes contact with the limiter 14 with the club face in contact or close contact with the ball. The left arm rests against the limiter at set up. As the left arm moves back in the backswing the body turns in unison, keeping the left arm against the limiter until at the very top of the backswing, the left arm then lifts off the limiter a couple of inches. Therefore with any movement of the left arm in the start of the downswing, the left arm contacts and puts pressure on the limiter forcing the hips to open and a weight to shift to the left side to occur. This happens automatically and long before impact, and forces the golfer into the proper impact position Now at the impact position the limiter 14, prevents the left arm from bending or sliding across the body, keeping the left arm straight and in front of the body in a preferred position. In addition the limiter helps to keep the left arm straight during the first part of the follow through to maintain the proper triangle between the arms and shoulders. In addition, the limiter causes the upper body to turn correctly, releasing the wrists and permitting the follow through extension of the arms, the left elbow is held in place just long enough, to causes the right hand to release and turn over the left, then the left arm slips off the limiter as the body turns, allowing the proper folding of the arms, in the remainder of the follow through.

As can now be understood depending upon the flexibility and strength of the golfer the limiter can be placed more to the center of the chest. The closer to the center, the more upper arm pressure there will be initially at address, the more pressure to turn the hips early and more and the sooner the weight shift will occur. Conversely moving the limiter further off center will place less force on opening the hips and will slow the weight transfer. It can be seen the present invention is intended to ensure certain body motions be learned to maximize power, distance, and direction control.

Figure 7:
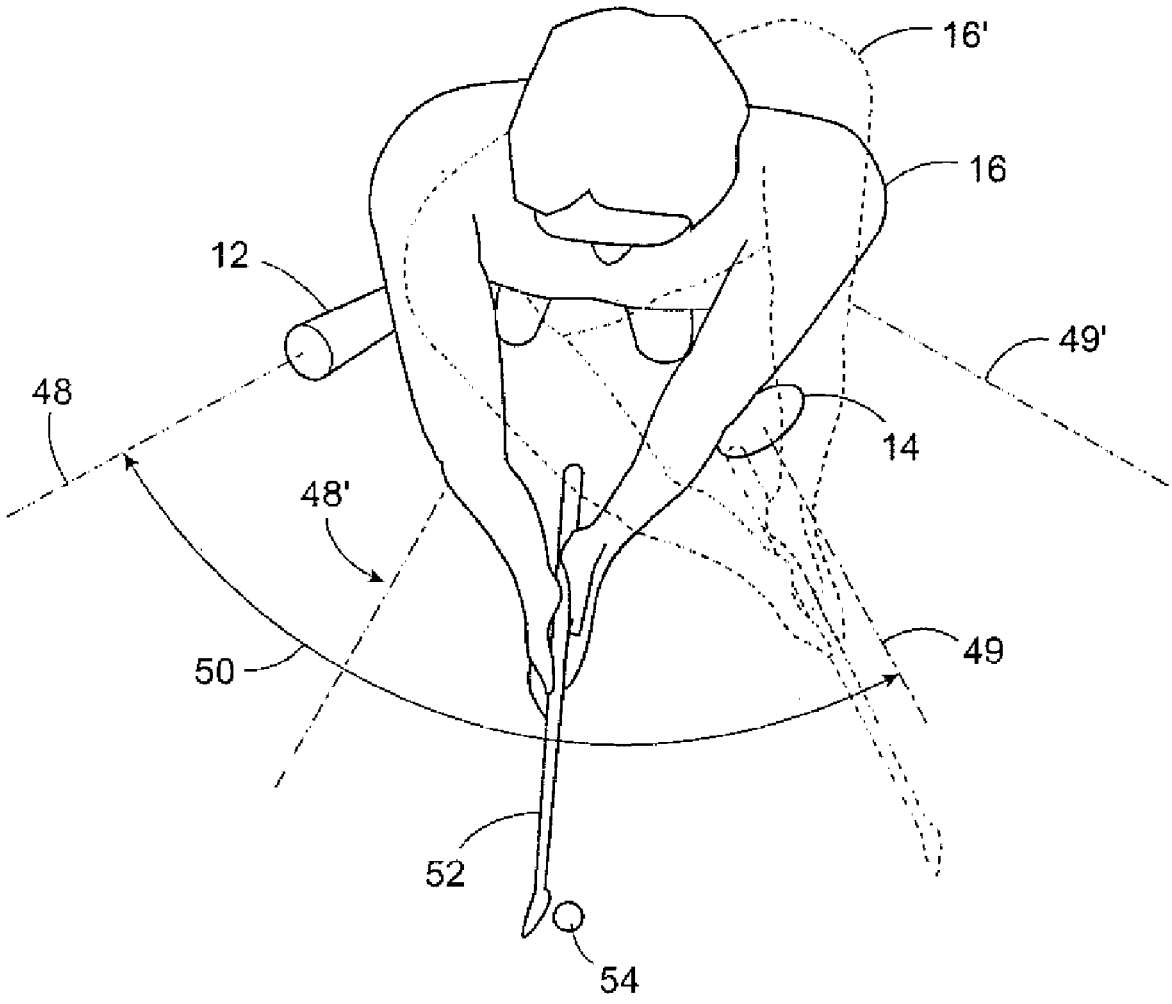
FIG. 7 shows a golfer from above wearing the swing training aid of the present invention at the top of the take-away portion of the swing and in a finish position in dotted outline.

FIG. 7 shows a top view of a golfer in the top of the backswing and the finish position in dotted outline. As can be seen, the guide 12 and limiter 14 extend outwardly and lie on projection lines 48, 49 which are approximately at 90° to one another. This defines a swing quadrant 50 and the quadrant is maintained in position on the body as the body position changes during the swing. Thus the present invention is directed to keeping the arms of the golfer within the swing quadrant so the golfer's arms and hands are in front of his chest, during the golf swing. Although the term quadrant is used, the actual arc angle between the controller aid guide can be more or less than 90°, for example as long as it generally maintains the arms between the two elements through the swing. Using an arc angle of less than 90O will open the hips earlier. The club 52 passes through a notional or actual impact with a ball position of 54. As shown in FIG. 7*b*, at the finish, the arms bend and lift off limiter 14 to complete the swing.

Figure 8:
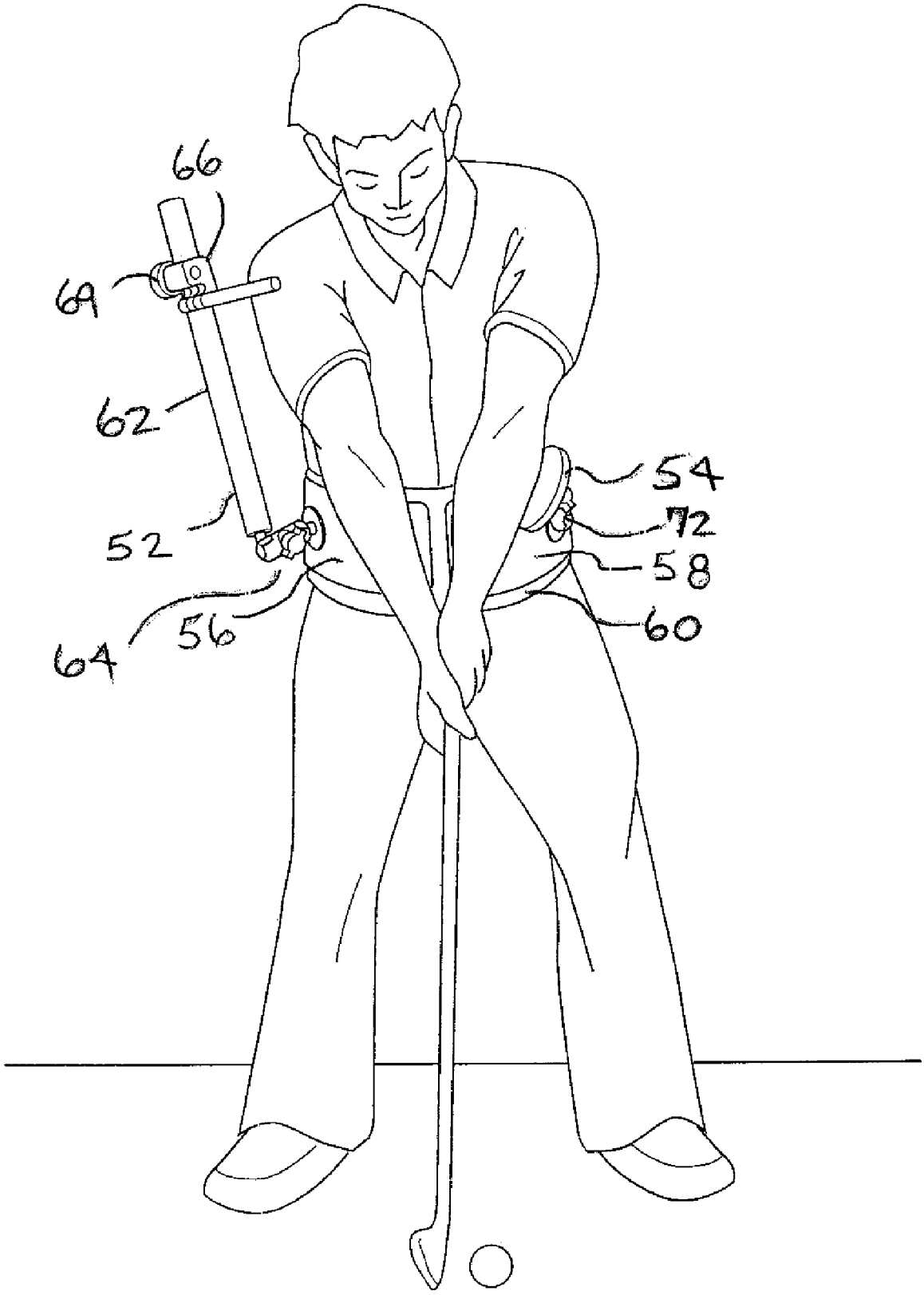
FIG. 8 shows a further embodiment of the present invention.

A further embodiment of the present invention is shown in FIG. 8. In this embodiment the elements function substantially the same but have been made more streamlined and light weight. As can be seen the embodiment of FIG. 8 shows a guide 52 and a limiter 54 each of which extends outwardly from a base 56 and 58 respectively. The bases 56 and 58 can be made curved, to fit around the body and lightweight such as from rigid plastic or aluminum or any other light weight material as will be appreciated by those skilled in the art. They are preferably attached to a belt 60, which is in the form of a wide supporting belt which includes stretchable material such as a form of elastic or rubberized material. Such a stretchable material has been found to give good results in helping to stabilize the belt on the torso of the wearer, but belt structures may also be used as described above. Hook and loop pile fasteners can be used to secure the belt to itself around the body to provide adjustability. In this way the appropriate amount of belt tension can be provided, which on the one hand is comfortable and yet on the other is secure enough to remain in place against the forces developed during use of the device. Most preferably, the bases 56 and 58 also include hook and loop pile fasteners on their underside to allow the bases to be releasably positioned and secured on the belt 60 to suit the individual swing physiology and characteristics of the user.

The guide 52 is formed from a light-weight member, such as a metal or plastic tube, 62, having a position joint 64 and a sliding stop 66. The sliding stop 66 can be loosened with a thumb screw 69, slid up or down on the tube 62 and then locked in place.

Figure 9:
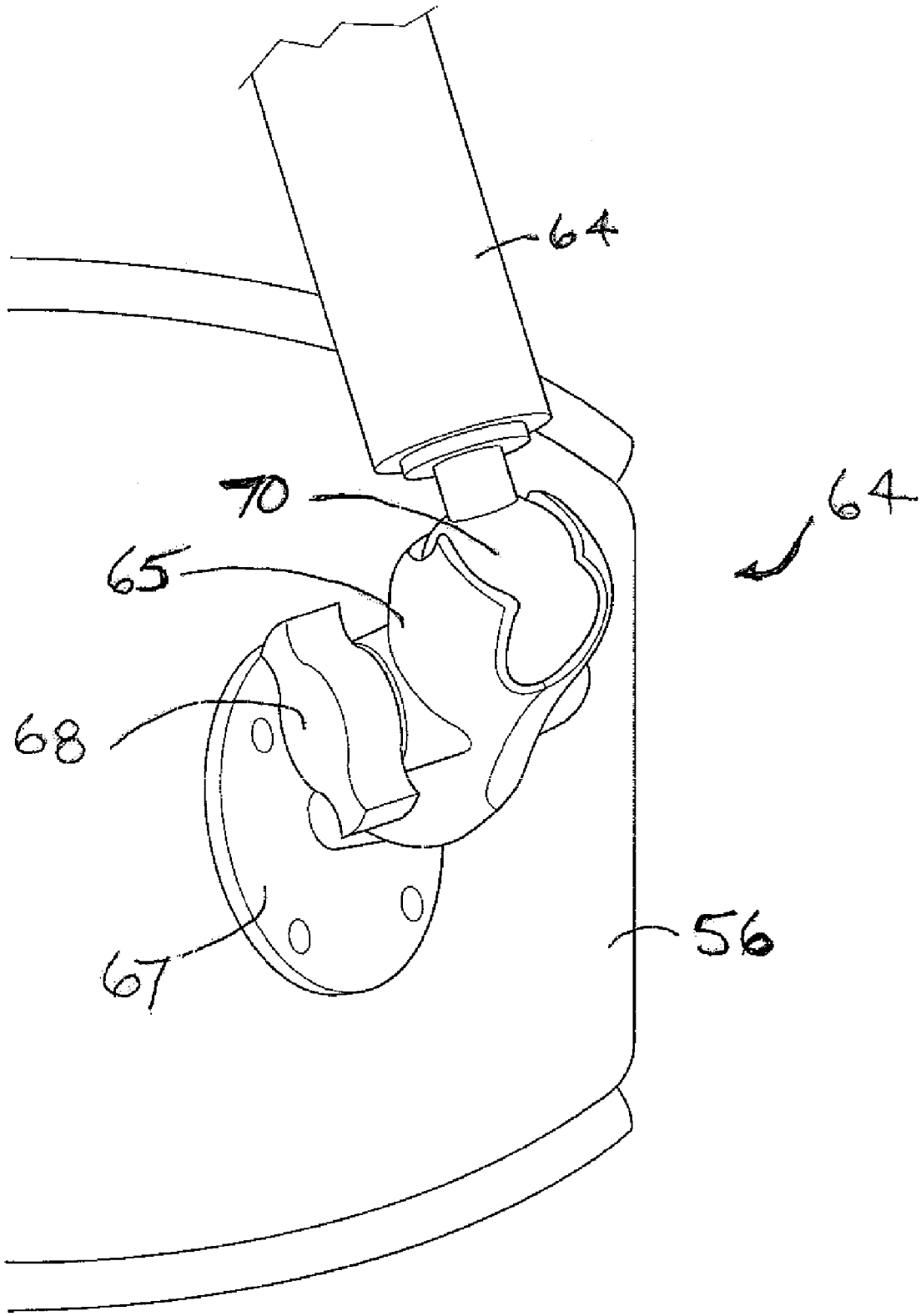
FIG. 9 shoes a close up of a joint of the invention of FIG. 8.

FIG. 9 shows a close up view of the joint 64, which includes an brace plate 67 secured to the base 56. A double socket element 65 connects a ball (not shown) anchored to the brace plate 67 and a ball 70 at the end of the tube member 64. As can now be understood most preferably the positioning joint 64 is a double ball joint allowing for the flexibility in positioning the guide to suit the body and swing of the user but which is convenient and easy to use. A thumb screw tightener 68 can be used to lock the joint in a given position through the application of a clamping force onto the balls in the socket element. A single or double ball joint 72 can be used for the limiter 54 (see FIG. 8). While a single ball joint is less expensive, a double ball joint enhances the range of positions, so the invention comprehends any adjustable attachment structure. As such joints will be familiar to those skilled in the art they are not described in any more detail herein. By way of example, the double ball joint 64 and thumb screw 68 the guide 52 can be easily and securely positioned in the desired location on the user's body. As can now be understood, the elasticized belt can be secured around the torso of the user and the two base plates fixed onto the belt in preferred locations. Because releasable hook and loop pile fasteners are used to connect the base plates to the belt, they are easy to adjust in position by simply peeling the base plates off and repositioning them on the belt. In this sense, both the limiter and guide are provided with attachment surfaces, which interface with an attachment area on the belt. Then the limiter and the guide can be positioned as needed anywhere on the attachment area and then the ball joints tightened. Then the user is ready to start swinging, within a customized fit and location of the two elements forming the swing training aid of the present invention.

It can now be appreciated that the present invention provides a torso mounted swing training aid having both a guide on the take-away and a limiter on the follow through that will help limit the position of the arms and body during the golf swing. Once the swing training aid is secured in place the golf swing can be repeated time and again and the two elements of guide and limiter will encourage the user to emulate a smooth sequenced swing. The swing can be repeated to build up both a muscle memory and the strength to swing the club along the preferred swing path. In the event that one of the take-away or the follow through needs to be practiced, the present invention comprehends leaving one element of the belt to allow only one side to be guided or controlled as the case may be. Thus, while the preferred form is to use both, the present invention comprehends using only one element at a time.

In summary therefore, in one preferred form of the invention the swing training aid provides as follows:

1. In the take-away portion a guide 12, to guide one arm of said golfer by:
   a. Keeping the arm in front of golfer's body during the backswing;
   b. Creating maximum arm extension, by letting the arm ride up the guide to a stop; and
   c. Furthermore, the guide is positioned on the user to permit the arm to slide down the guide, into the proper hitting area.
2. From the start of the downswing to the follow through portion of the swing the limiter 14:
   a. Turns or opens the hips ensuring proper weight shift;
   b. Keeps the leading arm straight at impact and for a portion of the swing thereafter;
   c. Forces the arms to stay in front of the chest from impact to follow through in the swing quadrant 50;
   d. Improves the extension of the arms in the classic triangle shape, by holding back the leading arm until the body is fully open at which point the leading arm moves clear of the limiter; and
   e. Momentarily stops the leading arm at a consistent position at or about the impact point, aiding in the turning over of the wrists and arms for a well timed release.

To facilitate the foregoing, there is provided a means for releasably securing and adjusting the guide 12 and the limiter 14 of the swing training aid 10 onto the body of a golfer.

The foregoing description has been made with reference to preferred embodiments of the invention as depicted in the description and drawings, but various modifications and alterations are comprehended by the broad scope of claims as appended hereto. Some of these variations have been described above and others will apparent to those skilled in the art. For example, while the position of the guide and the limiter can be adjusted on the body of the user by repositioning the belt, the position can also be adjusted by making the positions of the guide and the limiter adjustable on the belt itself. Either way, the guide and the limiter can be located in a manner to encourage a more controlled and preferred golf swing by the wearer. Also, it will be understood that the present invention is not limited to using both the limiter and the guide at the same time. Either one or other of the limiter and the guide may be used on their own, to train the specific aspects of the swing addressed by each component.

I claim:

1. A torso mountable wearable swing training aid for a golfer, for use in practicing a golf swing which golf swing includes a take-away portion, a down swing portion, a notional or actual impact portion, and a follow through portion, the swing training aid comprising:

a guide, mounted to a front of said swing training aid, said guide extending upwardly and outwardly therefrom and being positioned to slideably guide one arm of said golfer during said take-away portion and said down swing portion of said golf swing, said guide being otherwise detached from said arm;

a limiter mounted to a front of swing training aid, said limiter extending forwardly therefrom and being sized, shaped and positioned to limit the movement of the other arm of the golfer past said golfer's body during a golf swing, said limiter being otherwise detached from said other arm; and a means for releasably securing and adjusting the guide and the limiter of the swing training aid onto the front torso region of the golfer's body.

2. A swing training aid for golfers as claimed in claim 1 wherein said guide is in the form of an outwardly extending elongated element from said releasable securing means along which said one arm can slide during use.

3. A swing training aid for golfers as claimed in claim 2 wherein one or both of said guide or said limiter is padded for the comfort of the golfer.

4. A swing training aid for golfers as claimed in claim 2 wherein said guide may be independently positioned on said golfer from said limiter.

5. A swing training aid for golfers as claimed in claim 2 wherein said guide is fixed in position during said golf swing.

6. A swing training aid for golfers as claimed in claim 2 wherein said guide includes a cross member to limit the golfers swing to a preferred top position.

7. A swing training aid for golfers as claimed in claim 6 wherein said limit stop is adjustable to suit golfers of different sizes or swings.

8. A swing training aid for golfers as claimed in claim 6 wherein said limit stop is an element which extends from said guide, and said element is positionable on said guide at various distances along said guide.

9. A swing training aid for golfers as claimed in claim 1 wherein said limiter is independently positionable on said golfer from said guide.

10. A swing training aid for golfers as claimed in claim 1 wherein said limiter is located on an outwardly extending axis from said releasable securing means and is pivotally mounted on said axis.

11. A swing training aid for golfers as claimed in claim 1 wherein said limiter is generally rounded.

12. A swing training aid for golfers as claimed in claim 1 wherein said limiter is adjustably positioned on the releasable securing means.

13. A swing training aid for golfers as claimed in claim 1 wherein said releasable securing means includes means for adjusting said securing means to suit golfers of different sizes.

14. A swing training aid for golfers as claimed in claim 1 wherein said releasable securing means includes one or more of quick release buckles and hook and loop pile fasteners to undue said securing means.

15. A swing training aid for golfers as claimed in claim 1 wherein said means for release by securing said guide and said limiter to said body of the golfer comprises an elasticized belt having an outer attachment surface of one of hook and loop pile fasteners, and said guide and said limiters have the other of said hook and loop pile fasteners, so said guide and said limiter can be adjustably positioned on said belt.

16. A swing training aid for a golfer, for use in practicing a golf swing, wherein said golf swing includes a take-away portion, a down swing portion, a notional or actual impact portion and a follow through portion, the swing training aid comprising:

a belt, said belt configured to fit about the golfer's torso, said belt having a front and a back;

a guide, said guide releasably and adjustably mounted to said front of said belt, said guide extending upwardly and outwardly from said front of said belt and being positioned to slideably guide one arm of said golfer during said take-away portion and said down swing portion of said golf swing, said guide being otherwise detached from said arm; and a limiter releasably and adjustably mounted to said front of said belt, said limiter extending forwardly from said belt, said limiter being sized, shaped and positioned to contact the other arm of the golfer during the notional or actual impact portion of said golf swing, said limiter limiting movement of the other arm of the golfer past the golfer's body, said limiter being otherwise detached from said other arm.

* * * * *